United States Patent [19]

Matsumura et al.

[11] Patent Number: 5,013,626

[45] Date of Patent: May 7, 1991

[54] CARRIER OF A MAGNETIC POWDER DISPERSED TYPE

[75] Inventors: Yasuo Matsumura; Takayoshi Aoki; Ikutaroh Nagatsuka; Masao Mochizuki, all of Kanagawa, Japan

[73] Assignee: Fuji Xerox Co., Ltd., Tokyo, Japan

[21] Appl. No.: 525,230

[22] Filed: May 21, 1990

Related U.S. Application Data

[63] Continuation of Ser. No. 252,330, Oct. 3, 1988, abandoned.

[30] Foreign Application Priority Data

Oct. 6, 1987 [JP] Japan ..... 62-250639

[51] Int. Cl.[5] ..... G03G 9/107

[52] U.S. Cl. ..... 430/106.6; 430/108; 430/111

[58] Field of Search ..... 430/106.6, 108, 111

[56] References Cited

U.S. PATENT DOCUMENTS 4,600,675 7/1986 Iwasa et al. ..... 430/108 X

FOREIGN PATENT DOCUMENTS 55-130547 10/1980 Japan ..... 430/111
60-26351 2/1985 Japan ..... 430/106.6
61-15156 1/1986 Japan ..... 430/106.6

*Primary Examiner*—Roland Martin
*Attorney, Agent, or Firm*—Finnegan, Henderson, Farabow, Garrett, and Dunner

[57] ABSTRACT

A magnetic powder-dispersed carrier for use in electrophotography, electrostatic printing, and other reprographic methods, comprising a large number of magnetic particles dispersed in a binder resin, the particles having a BET surface area no greater than 5 $m^2/g$, and an oil-absorbing capacity of no more than 25 ml/100 g.

6 Claims, No Drawings

CARRIER OF A MAGNETIC POWDER DISPERSED TYPE

This application is a continuation of application Ser. No. 07/252,330, filed Oct. 3, 1988, now abandoned.

BACKGROUND OF THE INVENTION

1. Field of the Invention

The present invention relates to a carrier which is a component of a two-component developer used to develop a latent electrostatic or magnetic image in electrophotography, electrostatic recording, electrostatic printing or other reproduction methods. More particularly, the present invention relates to a carrier of a magnetic powder dispersed type.

2. Description of the Related Art

A method commonly employed in electrophotography comprises the steps of forming a latent image on a photoreceptor comprised of selenium or other photoconductive materials through a variety of electrical means, and rendering the latent image visible by depositing toner particles using a magnetic brush method. In this step of development, carrier particles, which are simply referred to as "carriers," are employed to impart an appropriate level of positive or negative electric charge to the toner. Various types of carriers have been developed and used commercially.

While carriers are required to possess various characteristics, particularly important requirements include the following: appropriate chargeability, impact resistance, wear resistance, developability and service life. In light of these requirements, the prior art carriers have several problems. For example, iron oxide powders and other conductive carriers are capable of efficient development of a solid image, but their ability to reproduce fine-line images is rather poor. In addition, a special charge control agent must be incorporated in the toner to extend the service life. On the other hand, carriers having an insulation coating exhibit a long life and are capable of efficient reproduction of fine-line images. However, such coated carriers are poor in their ability to reproduce a solid image.

With a view to reducing or eliminating the effects of these drawbacks, so-called "microtoning carriers," or small-particle carriers having fine magnetic particles dispersed in a binder resin, have been proposed and commercially used, as described in JP-A-53-83630. However, because of the small diameter of the carriers, they suffer from the disadvantage of being deposited on the photoreceptor. This phenomenon could be prevented by increasing the diameter of the carrier particles, but then their chargeability is reduced, resulting in problems such as fogging and fouling of the developing machine.

Carriers having magnetic particles dispersed in a resin are generally referred to as dispersed carriers. Compared with ordinary carriers employing iron oxide or ferrite particles as nuclei, such "dispersed carriers" produce a smaller magnetic force per particle. Although this property is a factor that contributes to improvement in the quality of a developed image, it also is a potential cause of carrier deposition on the image (including both image areas and background areas).

SUMMARY OF THE INVENTION

The principal object, therefore, of the present invention is to provide a novel carrier for use in the development of a latent electrostatic image by the magnetic brush method in electrophotography or electrostatic recording, which novel carrier eliminates or reduces the drawbacks of prior art carriers described above.

It is another object of the present invention to increase the magnetic force of carrier particles to an extent that will not impair image quality.

To achieve the foregoing objects, and in accordance with the purposes of the invention as embodied and broadly described herein, there is provided a magnetic powder dispersed carrier comprising a binder resin having magnetic particles dispersed therein. The magnetic particles have a Brunauer-Emmet-Teller (BET) surface area of not more than about 5 $m^2/g$ and an oil absorbing capacity of not more than about 25 ml/100 g.

DETAILED DESCRIPTION OF THE PREFERRED EMBODIMENTS

The dispersed carrier of the present invention may be produced by either a kneading and grinding method in which a magnetic powder and a binder resin are mixed in a molten state and the mixture is finely ground after cooling. Alternatively, the carriers may be produced by a spray cooling method wherein the molten mixture of a magnetic powder and a binder resin is spray-cooled.

For the purpose of dispersing a large number of magnetic particles within a binder resin, it is important that the magnetic particles have a small specific area and a small capacity for oil absorption. The magnetic particles have a BET surface area not greater than about 5 $m^2/g$, preferably, from 0.3 to 5 $m^2/g$ and more preferably from 0.5 to 4 $m^2/g$, and an oil absorbing capacity of not more than about 25 ml/100 g.

If magnetic particles having a BET surface area greater than 5 $m^2/g$ are added in a large amount, an increase in melt viscosity results which is too great to ensure uniform mixing of the magnetic powder and binder resin. Even if the BET surface area is less than 5 $m^2/g$, an increase in melt viscosity also occurs in the step of mixing and kneading the magnetic particles with the resin if their capacity for oil absorption exceeds 25 ml/100 g. If the viscosity of the mixture increases, its fluidity becomes too low to produce a uniform melt and problems will occur such as a high load on the kneader and inability to recover the mixture from the kneader. The magnetic powder and the binder resin may appear to have been uniformly mixed, but when observed after grinding and granulating operations the distribution of magnetic particles is not uniform and the carrier particles will eventually be deposited on the photoreceptor. In addition, when granulation is to be performed by the spray cooling method, the increase in viscosity will cause clogging of the spray nozzle.

The magnetic particles used in the present invention may be selected from among ordinary ferromagnetic fine powders including $Fe_3O_4$, $\gamma$-$Fe_2O_3$, various ferrite powders, chromium oxide, and fine powders of various metals such as iron, nickel and stainless steel. The magnetic particles of the present invention preferably have an average particle size of from 0.2–10 $\mu$m and more preferably from 0.2–5 $\mu$m.

The binder resin is typically selected from among polyolefinic compounds which are polymers of olefins such as ethylene, propylene, butylene and isobutylene. Besides these polymers, resins that are prepared by homopolymerizing or copolymerizing the following monomers are also usable: styrenes such as styrene, chlorostyrene and vinylstyrene; monoolefins such as ethylene, propylene, butylene and isobutylene; vinyl esters such vinyl acetate, vinyl propionate, vinyl benzoate and vinyl butyrate; esters of α-methylene aliphatic monocarboxylic acids such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone. Among these homopolymers and copolymers, the following are most typical as binder resins: polystyrene, styrene/alkyl acrylate copolymer, styrene/alkyl methacrylate copolymer, styrene/acrylonitrile copolymer, styrene/butadiene copolymer, styrene/maleic anhydride copolymer, polyethylene, and polypropylene. Also usable as binder resins are polyesters, polyurethanes, epoxy resins, silicone resins, polyamides, modified resins, paraffins, and waxes.

The magnetic powder is normally incorporated in an amount ranging from about 30 to about 95% by weight of the entire quantity of carrier, preferably from about 45 to about 90% by weight, and with the range from about 75 to about 90% weight being particularly preferred.

It will be effective for the purpose of controlling the chargeability of the carrier to disperse a variety of charge control agents in the binder. It is also possible to incorporate coupling agents, fillers and other components in the binder. After granulation by grinding or spray cooling, the carrier particles may be coated with resins or otherwise surface-treated with various fine powders. The carrier of the present invention generally has an average particle size of 20–400 μm, and preferably 30–200 μm.

The magnetic powder and the resin may be mixed in a molten state using a variety of known apparatus including an attritor, a pressure kneader, a Banbury mixer, a roll mill, a sand mill, and a Henschel mixer.

The BET surface area of the magnetic particles in the carrier of the present invention is measured with a BET surface area analyzer. The oil absorbing capacity (oil absorption) of the magnetic particles is measured by the following method: a 100 g of magnetic powder sample is weighed on a glass plate; an amount of linseed oil is dropped from a burette and the mixture is kneaded with a spatula; the amount of linseed oil added per 100 g of sample is measured until the mixture forms a single mass that can be fluidized with the spatula.

The following examples are provided without limitation on the scope of the invention for the purpose of further illustrating the invention.

EXAMPLE 1

Three samples having the formulations shown in Table 1 were melt mixed in a pressure kneader and those which were successfully mixed were ground into particles with a jet mill and classified to form carriers having an average particle size of 50 μm. These carriers were mixed with a toner and the resulting developers were employed in copying with a modified model of an FX 3500 (an electrophotographic copier of Fuji Xerox Co., Ltd.). The results of evaluation of image quality in terms of carrier deposition on both image area and background area are also shown in Table 1. The deposition of carrier was examined in copying of a multiline test chart (2 line-pair/mm).

TABLE 1

| | Composition: 85 wt % magnetic powder 15 wt % binder resin | | | | |
|---|---|---|---|---|---|
| | Magnetic Powder | | | | |
| Sample | BET surface area ($m^2/g$) | Oil absorption (ml/100 g) | Binder resin | Carrier production | Carrier deposition |
| A | 4 | 26 | styrene/n-BMA* resin | successful | extensive |
| B | 3.3 | 16 | styrene/n-BMA* resin | successful | absent |
| C | 6.4 | 18 | styrene/n-BMA* resin | unsuccessful | evaluation impossible |

*n-BMA: n-butyl methacrylate

A carrier that justified evaluation could not be obtained from sample C because of the overload on the kneader.

The carrier deposited on the image produced with sample A was found to contain only 72% magnetic powder, further indicating uneven distribution of magnetic particle on account of the poor dispersibility during mixing.

Sample B was satisfactory in terms of both carrier production and image quality.

EXAMPLE 2

Three samples having the formulations shown in Table 2 were melt mixed in a pressure attritor and those which were successfully mixed were granulated by spray cooling the mixture with a spray dryer equipped with a disk-shaped nozzle. The granules were classified to form carriers having an average particle size of 70 μm. These carriers were mixed with a toner and the resulting developers were employed in copying with a modified model of an FX 3500. The results of evaluation of image quality are also shown in Table 2.

TABLE 2

| | Composition: 85 wt % magnetic powder 15 wt % binder resin | | | | |
|---|---|---|---|---|---|
| | Magnetic Powder | | | | |
| Sample | BET surface area ($m^2/g$) | Oil absorption (ml/100 g) | Binder resin | Carrier production | Carrier deposition |
| A | 5.5 | 21 | polyethylene wax (400 P of Mitsui Hiwax Co., Ltd.) | successful | extensive |
| B | 5.8 | 26 | polyethylene wax (400 P of Mitsui Hiwax Co., Ltd.) | unsuccessful | evaluation |
| C | 2.6 | 22 | polyethylene wax (400 P of Mitsui Hiwax Co., Ltd.) | successful | absent |

Sample B increased so much in viscosity upon mixing (more than 200 Poise at 200° C.) that the mixture could not be recovered from the attritor.

Sample A was successfully granulated but because of uneven dispersion of magnetic particles, the carrier prepared from this sample was deposited extensively on the image.

Sample C was satisfactory in terms of both carrier production and image quality.

The carrier of the present invention is a dispersed carrier that employs magnetic particles whose specific surface area and oil absorbing capacity are adjusted, not to exceed certain values. Since these magnetic particles are highly miscible with binder resins, they can be incorporated uniformly and in large quantities to increase the efficiency of carrier production. Furthermore, the carrier thus produced will not be deposited on an image to impair its quality.

Additional advantages and modifications will readily occur to those skilled in the art. The invention in the broader aspects is, therefore, not limited to the specific details, representative apparatus and illustrative examples shown and described. Accordingly, departures may be made from such details without departing from the spirit or scope of applicant's general inventive concept.

What is claimed is:

1. A magnetic powder-dispersed carrier, comprising:

a binder resin; and magnetic particles dispersed within said binder resin, said magnetic particles having a BET surface area not more than about 3.3 $m^2/g$ and an oil absorbing capacity of not more than about 22 ml/100 g.

2. The carrier of claim 1, wherein said resin selected from the group consisting of a polymer of olefin, a copolymer of styrene, a copolymer of monoolefin, a copolymer of vinyl ester, a copolymer of ester of α-methylene aliphatic monocarboxylic acid, a copolymer of vinyl ether, a copolymer of vinyl ketone, polyester, polyurethane, epoxy resins, silicone resins, polyamides, modified rosin, parafin and wax.

3. The carrier of claim 1, wherein said magnetic particles comprise between 30 to 95% by weight of the carrier.

4. The carrier of claim 1, wherein said magnetic particles comprise between 75 to 90% by weight of the carrier.

5. The carrier of claim 1, wherein said carrier has an average particle size of from 20 to 400 μm.

6. The carrier of claim 1, wherein said magnetic particle has an average particle size of from 0.2 to 10 μm.

* * * * *